US009068737B2

(12) United States Patent
Kirchberger et al.

(10) Patent No.: US 9,068,737 B2
(45) Date of Patent: Jun. 30, 2015

(54) LIGHTING DEVICE

(75) Inventors: Guenter Kirchberger, Sinzing (DE); Thorsten Pauli, Mintraching (DE)

(73) Assignee: CSRAM GmbH, Munich (DE)

( * ) Notice: Subject to any disclaimer, the term of this patent is extended or adjusted under 35 U.S.C. 154(b) by 112 days.

(21) Appl. No.: 13/640,267

(22) PCT Filed: Mar. 29, 2011

(86) PCT No.: PCT/EP2011/054819

§ 371 (c)(1),
(2), (4) Date: Dec. 19, 2012

(87) PCT Pub. No.: WO2011/124505

PCT Pub. Date: Oct. 13, 2011

(65) Prior Publication Data

US 2013/0201683 A1 Aug. 8, 2013

(30) Foreign Application Priority Data

Apr. 9, 2010 (DE) ..... 10 2010 014 307

(51) Int. Cl.
*F21V 21/30* (2006.01)
*F21V 21/14* (2006.01)
*F21S 6/00* (2006.01)
(Continued)

(52) U.S. Cl.
CPC ..... *F21V 21/30* (2013.01); *F21S 6/002* (2013.01); *F21S 6/003* (2013.01); *F21V 21/14* (2013.01); *F21Y 2101/02* (2013.01); *F21Y 2105/008* (2013.01); *F21Y 2113/02* (2013.01)

(58) Field of Classification Search
CPC ..... F21V 21/14; F21V 21/30; F21V 2008/00; F21V 2008/001; F21S 6/006; F21S 6/0003; F21S 6/002; F21S 6/005
USPC ..... 362/132, 136, 184, 249.02, 311.02, 362/410, 413, 414, 285, 367, 373, 235, 362/249.01, 249.1, 427, 275, 249.06, 362/249.07
See application file for complete search history.

(56) References Cited

U.S. PATENT DOCUMENTS 2,218,013 A * 10/1940 Tice et al. ..... 362/35
D228,422 S * 9/1973 Stahl ..... D6/308
(Continued)

FOREIGN PATENT DOCUMENTS

CN 200955697 10/2007
CN 101297238 10/2008
(Continued)

*Primary Examiner* — Elmito Breval
*Assistant Examiner* — Arman B Fallahkhair
(74) *Attorney, Agent, or Firm* — Cozen O'Connor

(57) ABSTRACT

A lighting device (100), comprising: a ring-shaped first carrier (1) having at least one first light source (11) on the first carrier (1) and a ring-shaped first light emission area (12) disposed downstream of the first light source; (11), and a second carrier (2) having at least one second light source (21), having at least one third light source (31), having a second light emission area (22) disposed downstream of the second light source (21) and having a third light emission area (32) disposed downstream of the third light source (31), wherein, via the second and third light emission areas (22, 32), light is emitted in respectively opposite emission directions (20, 30), and wherein the second carrier (2) is arranged within the ring-shaped first carrier (1) and the first and second carriers (1, 2) are mounted rotatably relative to one another about a rotation axis (3) wherein the rotation axis (3) extends along a diameter of the ring-shaped first carrier (1).

12 Claims, 6 Drawing Sheets

(51) Int. Cl.

| | |
|---|---|
| *F21Y 101/02* | (2006.01) |
| *F21Y 105/00* | (2006.01) |
| *F21Y 113/02* | (2006.01) |

(56) References Cited

U.S. PATENT DOCUMENTS

| | | | | |
|---|---|---|---|---|
| 4,025,777 | A * | 5/1977 | Hayakawa | 362/249.07 |
| 5,690,420 | A * | 11/1997 | Saldana, Sr. | 362/540 |
| 5,997,149 | A * | 12/1999 | Chu | 362/142 |
| 7,461,948 | B2 * | 12/2008 | van Voorst Vader et al. | 362/244 |
| 7,717,599 | B2 | 5/2010 | Grace et al. | |
| 7,824,074 | B2 * | 11/2010 | Liou et al. | 362/269 |
| 8,297,790 | B2 * | 10/2012 | Kong | 362/249.02 |
| 8,356,908 | B1 * | 1/2013 | Zadro | 362/136 |
| 8,414,164 | B2 * | 4/2013 | Ogawa et al. | 362/373 |

FOREIGN PATENT DOCUMENTS

| | | |
|---|---|---|
| CN | 201651972 | 11/2010 |
| DE | 299 19 055 | 3/2000 |
| DE | 203 17 978 | 3/2004 |
| DE | 20 2009 009 845 | 11/2009 |
| EP | 2 128 516 | 5/2009 |
| GB | 2 420 172 | 5/2006 |
| JP | 2006 012755 | 1/2006 |
| JP | 2009 206030 | 9/2010 |
| WO | WO 2007/049176 | 5/2007 |

* cited by examiner

LIGHTING DEVICE

RELATED APPLICATIONS

This is a U.S. National phase Application under USC 371 of International Application PCT/EP2011/054819 filed on Mar. 29, 2011.

This patent application claims the priority of German patent application 10 2010 014 307.3 filed Apr. 9, 2010, the disclosure content of which is hereby incorporated by reference.

FIELD OF THE INVENTION

A lighting device is specified.

BACKGROUND OF THE INVENTION

The color and/or color temperature desired for direct object or surface lighting are/is often different than for indirect ambient lighting. Therefore, conventional luminaires afford either the possibility of object lighting or, as an alternative thereto, the possibility of ambient lighting. In order to obtain both functionalities, therefore, a luminaire comprising incandescent lamps, energy saving lamps or light emitting diodes for targeted object lighting and a further luminaire for the ambient lighting are typically combined.

SUMMARY OF THE INVENTION

It is an object of at least some embodiments to specify a lighting device comprising a plurality of light sources.

In accordance with at least one embodiment, a lighting device comprises at least one ring-shaped first carrier having at least one first light source on the first carrier and a ring-shaped first light emission area disposed downstream of the first light source. Furthermore, the lighting device comprises a second carrier, which has at least one second light source, at least one third light source, a second light emission area disposed downstream of the second light source and a third light emission area disposed downstream of the third light source, wherein, via the second and third light emission areas, light is emitted in respectively opposite emission directions. The second carrier is furthermore arranged within the ring-shaped first carrier, wherein the first and second carriers are mounted rotatably relative to one another about a rotation axis, and the rotation axis extends along a diameter of the ring-shaped first carrier.

By virtue of the fact that the second and third light emission areas emit light in opposite directions, the second carrier can advantageously simultaneously be used as object or surface lighting and as ambient lighting by virtue of the fact that light which is emitted, for example, by the second light source via the second light emission area can be directed onto an object to be illuminated or a surface to be illuminated. The light which is emitted by the third light source via the third light emission area in an opposite direction with respect thereto then advantageously only illuminates the surroundings of the object or of the surface. Furthermore, the rotatable arrangement of the first and second carriers relative to one another allows the first light source of the first carrier then to be able to emit light via the first lighting emission area optionally in the direction of the light of the second light source, optionally in the direction of the light of the third light source or in a direction that differs from these directions. A variable illumination with object or surface and simultaneously ambient lighting can be made possible as a result.

Particularly preferably, the second carrier can be configured as a two-sided surface luminaire, in particular for example as a circular two-sided surface luminaire. That can mean, in particular, that the second and third light emission areas are in each case embodied in a planar fashion, for example in the form of a circular disk having a smaller diameter than the ring-shaped first carrier, and are arranged within the ring-shaped first carrier. As a result, the second carrier within the ring-shaped first carrier can be rotatable relative to the first carrier about the rotation axis without the first and second carriers being able to mutually block one another with regard to rotatability.

Particularly advantageously, the first and/or second carrier can be rotatable about the rotation axis by an angle of greater than or equal to 360°, which can particularly preferably be made possible by virtue of the fact that the rotation axis is arranged along a diameter of the ring-shaped first carrier. As a result, the emission directions of the light respectively emitted by the first and/or the second and third light sources via the respective light emission area can be arbitrarily selectable. In one particularly advantageous embodiment, the first and second carriers can be rotatable independently of one another about the rotation axis, such that the respective emission directions are selectable independently of one another.

Furthermore, the lighting device can comprise a holding apparatus, at which the first carrier is arranged. In particular, the first carrier can be mounted at the holding device rotatably about the same rotation axis about which the first and second carriers are also mounted rotatably relative to one another. This enables the first and second carriers to be rotatably fixed to the holding apparatus with a common rotation axis. By means of the holding apparatus, the first and second carriers can advantageously be positionable spatially.

At least one of the first, second and third light sources can comprise at least one light emitting diode (LED), wherein here and hereinafter the terms light emitting diode and LED in each case denote an inorganic light emitting diode. Through the use of LEDs, a comparatively high light power can be emitted in comparison with conventional luminaires comprising incandescent or energy saving lamps in relation to the electrical power consumed, the evolution of heat and the structural size. In particular, the light emitted by the at least one LED can have an ultraviolet to infrared, and particularly preferably a visible, wavelength range. The at least one LED can be embodied, for example, as an LED chip in the form of a semiconductor layer sequence based on an arsenide, phosphide and/or nitride compound semiconductor material system, or else as a corresponding LED chip in a housing. Furthermore, the at least one LED can also have a potting and/or a dye for wavelength conversion in order to achieve a desired color locus and a desired color temperature of the emitted light.

Advantageously, the first, second and third light sources can in each case comprise at least one LED, and particularly preferably in each case a plurality of LEDs. As a result, for the light emitted by the first, second and third light sources via the respective light emission area can be adjustable with regard to the intensity, the color impression and the wavelength range. Particularly preferably, the light emitted by the first, second and third light emission areas can be emitted with in each case mutually different luminous impressions. A different luminous impression can result, for example, from a different intensity, a different color locus and/or a different wavelength range.

Particularly advantageously, the first light source of the first carrier can comprise a plurality of LEDs arranged in a ring-shaped fashion, that is to say along the ring-shaped configuration of the first carrier and the first light emission area. The second carrier can particularly advantageously comprise in each case a plurality of LEDs as second and third light sources, which LEDs can be arranged on the inner areas of the first carrier. In this case, in one particularly preferred embodiment, the first, second and third light sources can in each case emit white light having different color temperatures, that is to say in particular cold-white and/or warm-white light having mutually different color temperatures. Cold-white light can be particularly suitable for object or surface lighting, while warm-white light can be suitable for ambient lighting.

Furthermore, a diffuser and/or an optical waveguide can be disposed downstream of at least one light source selected from the first, second and third light sources. Particularly preferably, a diffuser and/or an optical waveguide can in each case be disposed downstream of each of the first, second and third light sources. By means of a diffuser, for example a scattering plate or a scattering film, and/or an optical waveguide, for example an optical waveguide embodied in a planar fashion, it is possible to achieve a distribution, in particular a uniform distribution, of the light emitted by a light source via the respective light emission area, as a result of which the corresponding light source can give a homogeneous luminous impression.

Furthermore, at least one or more of the first, second and third light source can also comprise an organic light emitting diode (OLED) instead of one or more LEDs. An OLED can advantageously be embodied as a planar light source, such that, for example, the light emission area of a light source can also be formed directly by an OLED.

Further advantages and advantageous embodiments and developments of the invention will become apparent from the embodiments described below in conjunction with FIGS. 1 to 7.

DETAILED DESCRIPTION OF THE DRAWINGS

In the exemplary embodiments and figures, identical or identically acting constituent parts may in each case be provided with the same reference signs. The elements illustrated and their size relationships among one another should not be regarded as true to scale, in principle; rather, individual elements, e.g. layers, structural parts, components and regions, may be illustrated with exaggerated thickness or size dimensions in order to enable a better illustration and/or in order to afford a better understanding.

Figure 1:
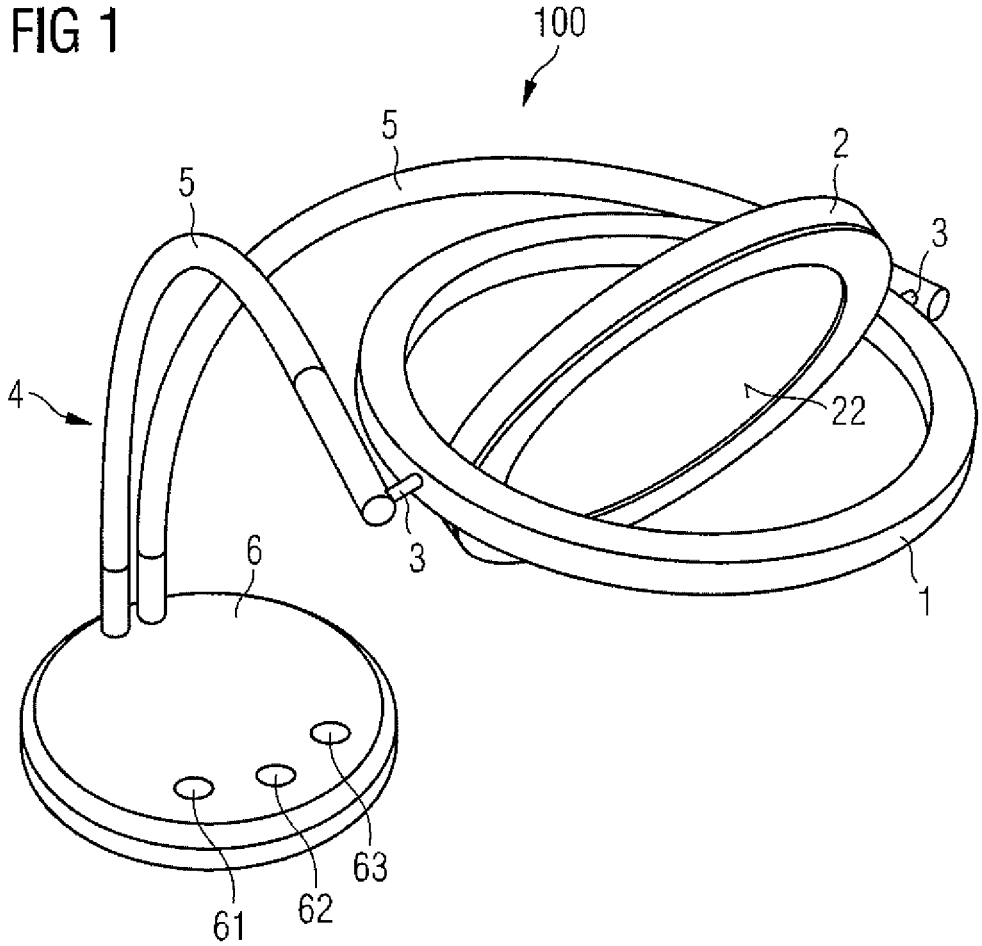
FIGS. 1 to 5 show schematic illustrations of different views of a light device in accordance with an exemplary embodiment.
Figure 2:
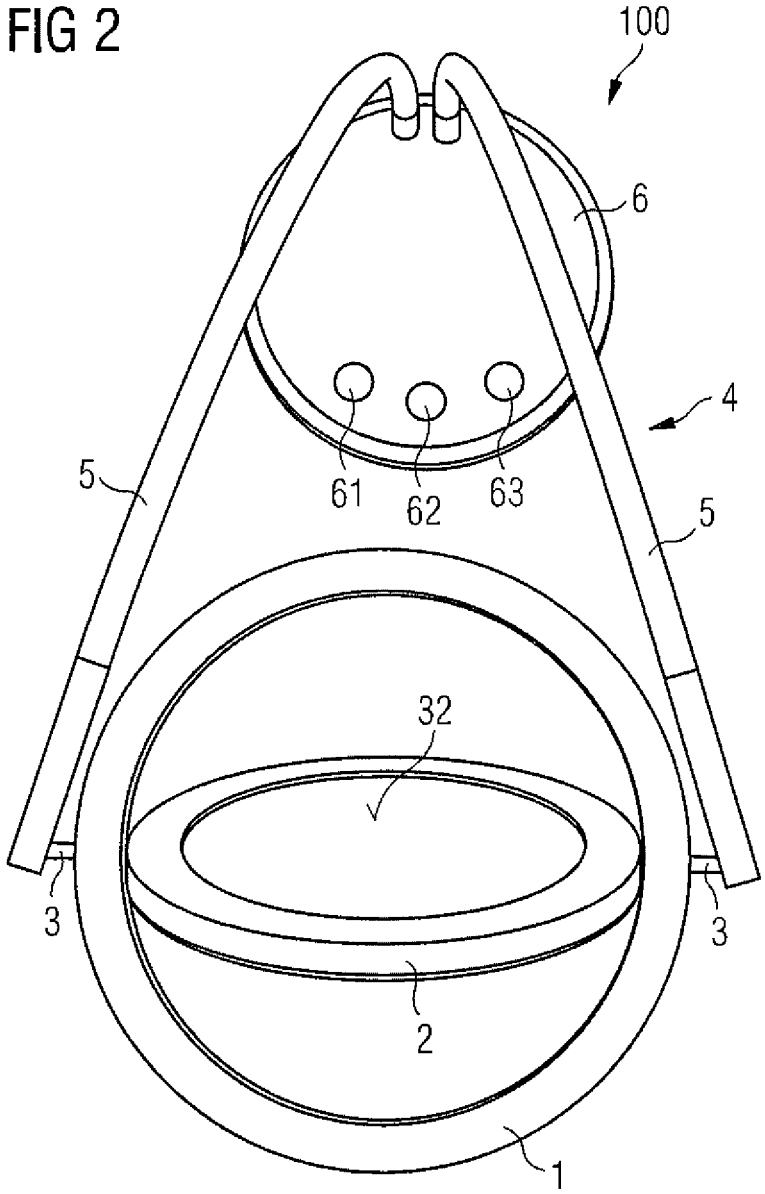
Figure 3:
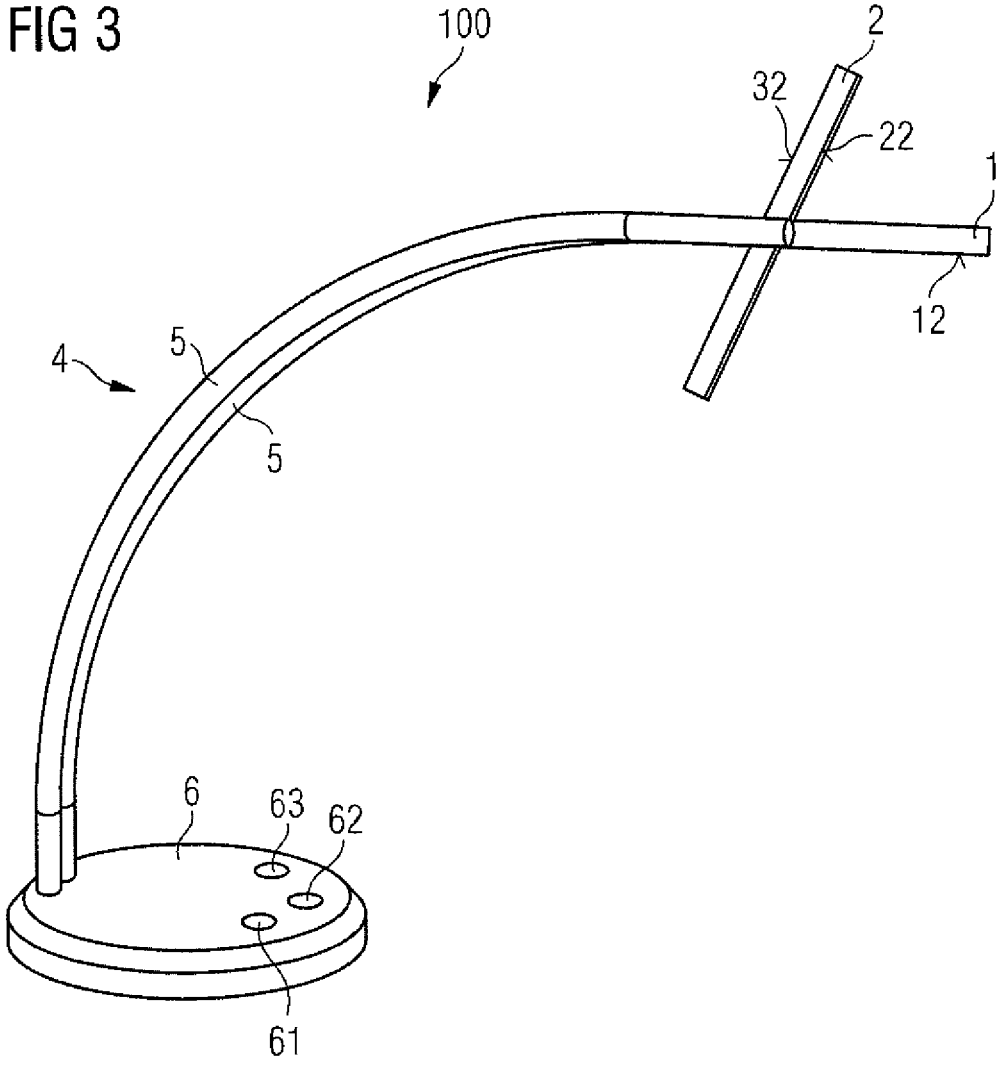
Figure 4:
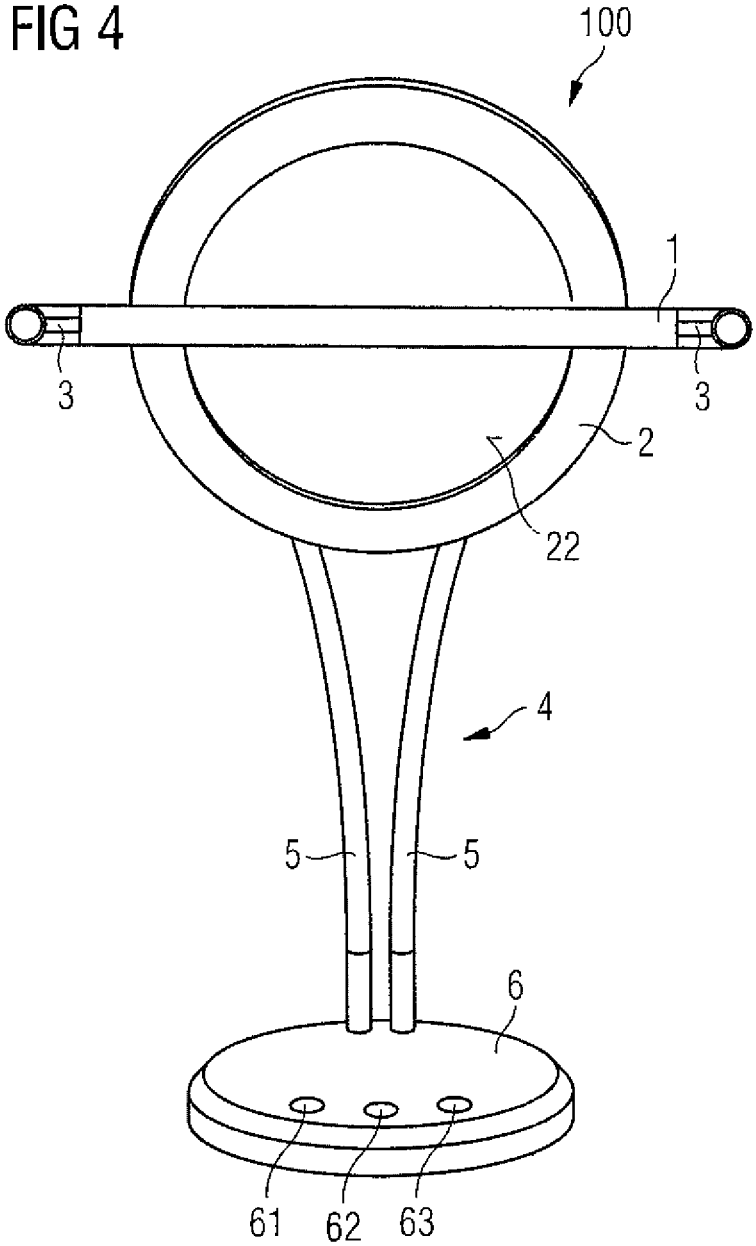
Figure 5:
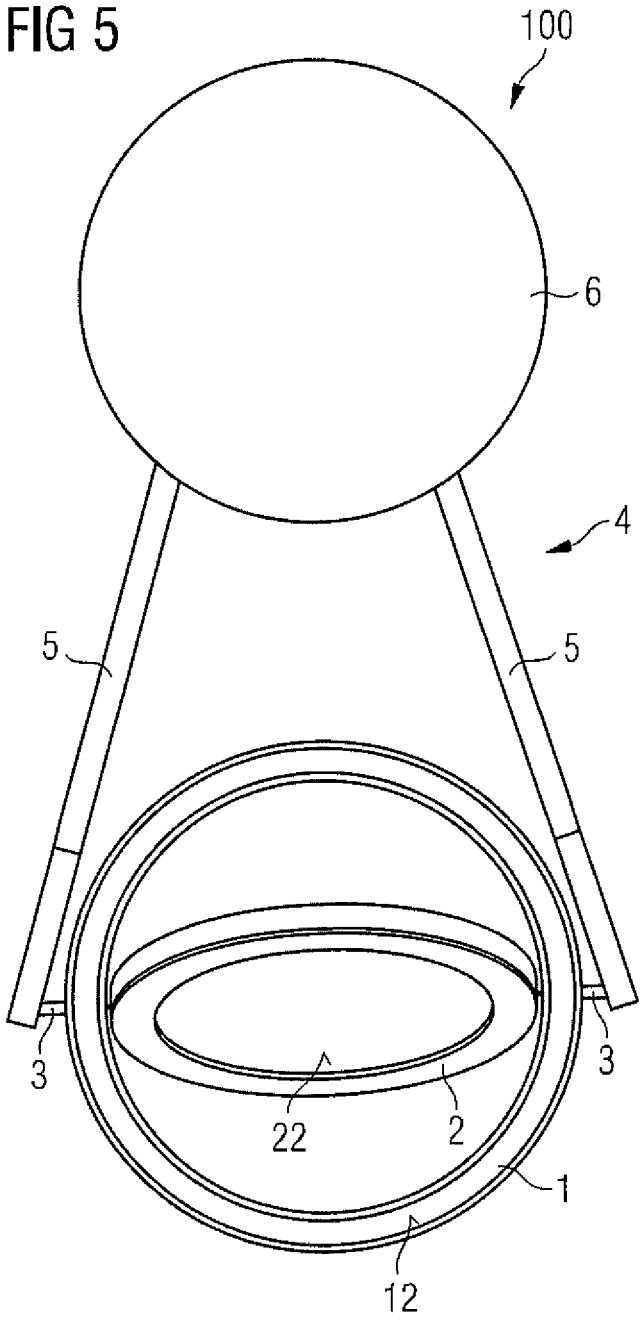

FIGS. 1 to 5 show different schematic views of a lighting device 100 in accordance with an exemplary embodiment. FIG. 1 shows the lighting device 100 in a three-dimensional view, while FIG. 2 shows a plan view from above, FIG. 3 shows a side view, FIG. 4 shows a plan view from the front and FIG. 5 shows a plan view from below. The following description relates equally to all of FIGS. 1 to 5.

The lighting device 100 comprises a ring-shaped first carrier 1 and a second carrier 2. The second carrier 2 is arranged within the ring-shaped first carrier 1, wherein the first and second carriers 1, 2 are mounted rotatably relative to one another about a rotation axis 3. In particular, the rotation axis 3 extends along a diameter of the ring-shaped first carrier 1. In other words, the second carrier 2 is arranged and rotatably mounted centrally with respect to the first carrier 1 along the diameter of the first carrier 1 within the first carrier 1. In this case, FIGS. 1 to 5 show an exemplary relative arrangement and orientation of the first carrier 1 with respect to the second carrier 2, wherein the orientation of the first and second carriers 1, 2 relative to one another can be altered by rotating the first carrier 1 relative to the second carrier 2 or the second carrier 2 relative to the first carrier 1.

Figure 6:
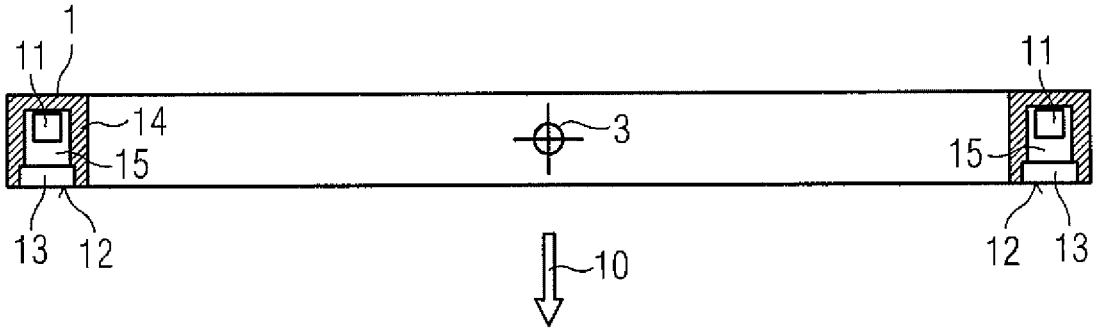
FIGS. 6 and 7 show schematic sectional illustrations of a first and second carrier of the lighting device.

FIG. 6 shows a sectional illustration of the ring-shaped first carrier 1 of the lighting device 100 with a sectional plane perpendicular to the rotation axis 3 indicated. The first carrier 1 has a ring-shaped, U-like profile 14 having a ring-shaped and circumferentially extending depression 15 and is produced from aluminum. Arranged in the depression 15 is a first light source 11, which, in the exemplary embodiment shown, comprises a plurality of light emitting diodes (LEDs), two LEDs of which are shown by way of example. The LEDs are arranged at regular distances extending circumferentially in the depression and emit a cold-white light in the exemplary embodiment shown. For this purpose, the LEDs are embodied as semiconductor chips based on a blue-emitting nitride semiconductor compound material, which are arranged in a housing with a dye that converts part of the blue light into yellow and/or green and red light, such that the superimposition of the blue light with the converted light produces cold-white light. LEDs of this type and also suitable amendments and modifications thereof are known to the person skilled in the art and will not be explained in further detail here.

The light generated by the first light source 11 is emitted via a first light emission area 12 of the first carrier 1, said first light emission area being disposed downstream of the first light source 11, along an emission direction indicated by the arrow 10. In the exemplary embodiment shown, the light emission area 12 is formed by a diffuser 13, which homogenizes the inhomogeneous emission characteristic generated by the plurality of mutually spaced-apart LEDs of the first light source 11 and thus enables a homogeneous and uniform luminous impression over the entire light emission area 12. For this purpose, the diffuser 13 is embodied as a scattering plate which homogenizes the light emitted by the light source 11 with regard to the spatial distribution and the angular distribution of said light. As an alternative or in addition to the diffuser 13, the first carrier 1 can also have an optical waveguide which, by means of suitable measures such as, for instance, scattering centers, reflective regions and/or light coupling-out structures, likewise enables the light of the first light source 11 to be emitted homogeneously and uniformly.

Figure 7:
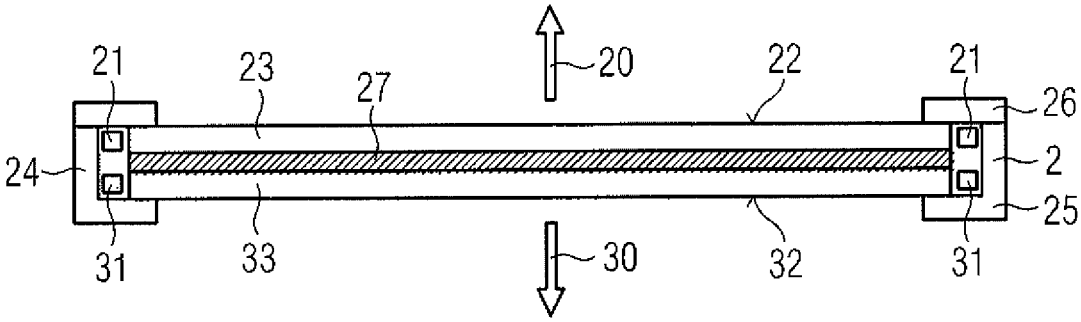

FIG. 7 illustrates a sectional illustration of the second carrier 2. The second carrier 2, as is also shown in FIGS. 1 to 5, is embodied in a circular fashion and has a somewhat smaller diameter than the ring-shaped first carrier 1, such that the second carrier 2 is rotatable within the first carrier 1 in a manner unimpeded by the first carrier 1.

The second carrier 2 has a ring-shaped profile 24 produced from aluminum. The profile 24 is formed by a ring 25 having an L-shaped profile and a cover 26.

Furthermore, the second carrier 2 has a second light source 21 in the form of a plurality of LEDs and a third light source 31 in the form of a further plurality of LEDs, which are in each case arranged on the inwardly directed side area of the profile 24 and thus at an inner area of the second carrier 2 in a manner such that they are regularly spaced apart from one another and ring-shaped. The respective LEDs of the second and third light sources 21, 31 emit light in a radial direction, that is to say in a direction of the midpoint of the profile 24.

The carrier 2 furthermore has an optical waveguide 23 and an optical waveguide 24, into which the light of the second and third light sources 21, 31 is respectively coupled. The optical waveguide 23 deflects the light of the second light source 21 in the emission direction 20, the optical waveguide 23 in this case forming the second light emission area 22. The optical waveguide 33 deflects the light of the third light source 31 in the opposite emission direction 30 relative to the emission direction 20, the optical waveguide 33 in this case forming the third light emission area 32. A reflector 27 in the form of a reflective silver film is arranged between the optical waveguides 23, 33 in order to prevent an optical crosstalk between the optical waveguides 23, 33 and thus also between the second and third light sources 21, 31 and in order at the same time to foster the deflection of the light emitted by the second and third light sources 21, 31 onto the second and third light emission areas 22, 32, respectively. As a result, the second and third light sources 21, 31 can emit light in the mutually opposite emission directions 20, 30.

The second and third light sources 21, 31 are embodied in a similar manner to the first light source 11, wherein the second light source 21 emits cold-white light having a color temperature different than or the same as the light emitted by the first light source 11 and the third light source 31 emits warm-white light. As a result, the first and second light sources 11, 21 are suitable for object lighting, for example while the third light source 31 simultaneously enables warm-white ambient lighting.

As an alternative to the respective light of the first, second and third light sources 11, 21, 31 as described here, however, said light sources can also respectively emit light having a different color and/or color temperature. By way of example, at least one of the first, second and third light sources 11, 21, 31 can also emit, instead of warm-white or cold-white light, colored light or else light having a color and/or color temperature that can be varied by means of a suitable control device.

As described above, for light emission the second light emission area 22 in the form of the optical waveguide 23 is disposed downstream of the second light source 21 while the third light emission area 32 in the form of the optical waveguide 33 is disposed downstream of the third light source 31. In this case, the optical waveguides 23, 33 are embodied and provided with scattering centers and/or light coupling-out structures, for example, in such a way that a homogeneous and uniform luminous impression is made possible in each case. Consequently, the second carrier 2 is embodied as a two-sided surface luminaire, wherein the second and third light emission areas 22, 32 are in each case embodied in the form of a circular disk.

As an alternative to the exemplary embodiment of the second carrier 2 as shown, said carrier can also comprise a carrier plate, for example, which extends along the rotation axis and on which the second and third light sources 21, 31 are arranged on opposite sides. Furthermore, the second carrier 2 can also comprise two diffusers, for example, instead of the optical waveguides 23, 33, said diffusers forming the second and third light emission areas 22, 32. As an alternative to the carrier plate mentioned above, the second and third light sources 21, 31 can also be arranged directly at the inner surface of the respective diffuser facing away from the respective light emission area.

As an alternative to the exemplary embodiment of the first and second carriers 1, 2 each having a plurality of LEDs as first, second and third light source 11, 21, 31, as described, at least one or a plurality or else all of the first, second and third light source 11, 21, can in each case also comprise an organic light emitting diode (OLED) instead of LEDs. In contrast to LEDs, OLEDs can also be embodied as planar light sources, such that, for example, a ring-shaped OLED can be used in the case of the first light source 11 and circular-disk-shaped OLEDs can respectively be used in the case of the second and light sources 21, 31. An OLED as light source with a downstream diffuser and/or optical waveguide can in this case give a homogeneous luminous impression. Furthermore, it may for example also be possible, however, that as a result of the planar emission of an OLED as light source, no additional diffuser and/or optical waveguide are/is required and, for example, the thickness of the first and/or second carrier 1, 2 can thus advantageously be reduced.

Purely by way of example, in the exemplary embodiment shown, the first carrier 1 has the profile 14 having an internal diameter of 170 mm, an external diameter of 200 mm and a thickness of 12 mm. In this case, the depression 15 has a depth of 10 mm, wherein the diffuser 13 is arranged in a 10 mm wide and 3 mm deep region and the first light source 11 is arranged in an 8 mm wide and 7 mm deep region of the depression 14.

The second carrier 2 has the ring 25 having an external diameter of 166 mm, an internal diameter of 130 mm, a wall thickness of 5.5 mm and a thickness of 10.5 mm, and the cover 26 having a corresponding internal diameter of 130 mm, a corresponding external diameter of 166 mm and a thickness of 1.5 mm.

The lighting device 100, as is furthermore shown in FIGS. 1 to 5, comprises a holding apparatus 4, at which the first carrier 1 is arranged and is furthermore mounted rotatably about the rotation axis 3. In this case, the first and second carriers 1, 2 are rotatable about the rotation axis 3 independently of one another in each case by an angle of greater than or equal to 360°, such that the emission directions 10 and also 20 and 30 are freely selectable and adjustable, thus resulting in a flexible and diversely usable lighting device.

In particular, the holding apparatus 4 comprises two rod-shaped holding elements 5, to which the first and second carriers 1, 2 are fixed rotatably via the rotation axis 3. In this case, the first carrier 1 is arranged along the rotation axis 3 between the rod-shaped holding elements 5. In this case, the rod-shaped holding elements 5 are produced from aluminum and have a curved course. In the exemplary embodiment shown, the rod-shaped holding elements 5 are embodied as tubes having a diameter of 12 mm, a straight part having a length of 50 mm, adjacent thereto a curved part having a radius of 294 mm and adjacent thereto a further straight part having a length of 70 mm, wherein the two straight parts are oriented perpendicularly to one another. This results in a total height of the rod-shaped holding elements 5 of 356 mm and perpendicularly thereto an extent of 376 mm.

Furthermore, the rod-shaped holding elements 5 approach one another in a direction facing away from the first carrier 1, as a result of which the rod-shaped holding elements 5, independently of the external diameter of the first carrier 1, can be fixed close together and thus in a space-saving manner to a foot part 6 of the holding apparatus 4. The foot part 6 is likewise produced from aluminum and, purely by way of example, has an external diameter of 180 mm and a thickness of 30 mm, the external diameter tapering under a height of 8 mm at an angle of 45° with respect to the top side of the foot part. The distance between the midpoints of the rod-shaped holding elements 5 on the foot part 6 is 20 mm.

Furthermore, the foot part 6 can have at least one control element, for example a switch and/or a regulator, by which at least one of the first, second and third light source 11, 21, 31 are controllable with regard to brightness and/or color and/or color temperature. Particularly preferably, the foot part 6 has a dedicated control element for each of the light sources 11, 21, 31, such that the light sources 11, 21, 31 can be driven independently of one another and the respectively emitted light can thus be set in a targeted manner according to the respective requirements in relation to direct surface or object lighting and indirect ambient lighting. In the exemplary embodiment shown, the foot part 6 comprises pushbuttons 61, 62, 63, by means of which a switching-on and -off of the first, second and third light sources 11, 21, 31 can be actuated. The pushbuttons 61, 62, 63 can be embodied as mechanical pushbuttons, for example pressure-operated pushbuttons, or else as contactless pushbuttons, for example by means of a so-called proximity sensor, for instance from Osram Opto Semiconductors with the designation SFH 7741. Furthermore, at least one of the rod-shaped holding elements 5 can have electrical feeds for the light sources 11, 21, 31, which are arranged, for example, in the interior of the rod-shaped holding element or elements 5. The electrical feeds can then be fed to the light sources via the rotation axis. The foot part 6 can furthermore have electrical leads or an electrical contact for connecting the lighting device 100 to an external power supply (not shown).

The possibility of the above-described up to three different color temperatures of the three light sources and the rotatable mounting of the first and second carriers 1, 2 makes it possible to use the lighting device 100 as a diverse surface luminaire, for example for object lighting, and simultaneously as ambient lighting.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A lighting device, comprising:

a ring-shaped first carrier having at least one first light source on the first carrier and a ring-shaped first light emission area disposed downstream of the first light source; and a second carrier embodied as a two-sided luminaire having at least one second light source, having at least one third light source, having a second light emission area disposed downstream of the second light source and having a third light emission area disposed downstream of the third light source wherein the first light source comprise at least one inorganic light emitting diode and each of the second and third light sources comprises an organic light emitting diode, wherein, via the second and third light emission areas, light is emitted in respectively opposite emission directions, and wherein the second carrier is arranged within the ring-shaped first carrier and the first and second carriers are mounted rotatably relative to one another about a rotation axis wherein the rotation axis extends along a diameter of the ring-shaped first carrier, wherein the first carrier and the second carrier are both rotatable about the same rotation axis, and wherein the first and second carrier are rotatable independently of one another about this same rotation axis, and wherein the second carrier is arranged and rotatably mounted centrally with respect to the first carrier along a diameter of the first carrier within the first carrier.

2. The lighting device according to claim 1, wherein the second and third light emission areas are in each case embodied in the form of a circular disk.

3. The lighting device according to claim 1, furthermore comprising a holding apparatus, at which the first carrier is arranged.

4. The lighting device according to claim 3, wherein the holding apparatus comprises two rod-shaped holding elements between which the first carrier is arranged along the rotation axis.

5. The lighting device according to claim 4, wherein the holding apparatus comprises a foot part, to which the two rod-shaped holding elements are fixed.

6. The lighting device according to claim 5, wherein the foot part comprises at least one control element for controlling the first, second and/or third light source.

7. The lighting device according to claim 4, wherein at least one of the two rod-shaped holding elements comprises an electrical feed for the first, second and/or third light source.

8. The lighting device according to claim 3, wherein the first carrier is mounted rotatably about the rotation axis at the holding apparatus.

9. The lighting device according to claim 3, wherein the two rod-shaped holding elements approach one another in a direction facing away from the first carrier.

10. The lighting device according to claim 1, wherein the second carrier and/or the first carrier are/is rotatable about the rotation axis by an angle of greater than or equal to 360°.

11. The lighting device according to claim 1, wherein a diffuser and/or an optical waveguide are/is in each case disposed downstream of the first, second and/or third light source.

12. The lighting device according to claim 1, wherein light having in each case mutually different luminous impressions is emitted by the first, second and third light emission areas.

* * * * *

UNITED STATES PATENT AND TRADEMARK OFFICE

CERTIFICATE OF CORRECTION

PATENT NO. : 9,068,737 B2
APPLICATION NO. : 13/640267
DATED : June 30, 2015
INVENTOR(S) : Guenter Kirchberger et al.

It is certified that error appears in the above-identified patent and that said Letters Patent is hereby corrected as shown below:

Title page, Item (73), change "CSRAM GmbH" to --OSRAM GmbH--.

Signed and Sealed this
Twelfth Day of January, 2016

Michelle K. Lee

Michelle K. Lee
*Director of the United States Patent and Trademark Office*